US008084678B2

(12) United States Patent
McMillen et al.

(10) Patent No.: US 8,084,678 B2
(45) Date of Patent: Dec. 27, 2011

(54) SENSOR BOW FOR STRINGED INSTRUMENTS

(75) Inventors: Keith McMillen, Berkeley, CA (US); Barry Threw, San Francisco, CA (US); Chuck Carlson, Berkeley, CA (US); Joel Davel, Oakland, CA (US); Don Buchla, Berkeley, CA (US)

(73) Assignee: Kesumo LLC, Berkeley, CA (US)

( * ) Notice: Subject to any disclaimer, the term of this patent is extended or adjusted under 35 U.S.C. 154(b) by 148 days.

(21) Appl. No.: 12/467,136

(22) Filed: May 15, 2009

(65) Prior Publication Data

US 2009/0308232 A1 Dec. 17, 2009

Related U.S. Application Data

(60) Provisional application No. 61/055,087, filed on May 21, 2008.

(51) Int. Cl.
*G10H 3/00* (2006.01)

(52) U.S. Cl. ..... 84/723; 84/282

(58) Field of Classification Search ..... 84/281–283, 84/723

See application file for complete search history.

(56) References Cited

U.S. PATENT DOCUMENTS

| | | | | |
|---|---|---|---|---|
| 4,805,510 | A * | 2/1989 | De Dianous | 84/723 |
| 5,117,730 | A | 6/1992 | Yamauchi | |
| 5,340,941 | A * | 8/1994 | Okamoto et al. | 84/658 |
| 5,661,253 | A * | 8/1997 | Aoki | 84/658 |
| 7,084,337 | B1 * | 8/2006 | Schroeder | 84/274 |
| 7,297,864 | B2 * | 11/2007 | Ueshima et al. | 84/724 |
| 7,605,317 | B2 * | 10/2009 | Chen et al. | 84/281 |
| 2009/0308232 | A1 * | 12/2009 | McMillen et al. | 84/723 |

FOREIGN PATENT DOCUMENTS

| | | |
|---|---|---|
| JP | 04-085598 | 3/1992 |
| JP | 7-74954 | 8/1995 |
| JP | 10-198363 | 7/1998 |

OTHER PUBLICATIONS

Young, Diana S., New Frontiers of Expression Through Real-Time Dyamics Measurement of Violin Bows, Masters Thesis, MIT Sep. 2001.

Rasamimanana, Nicolas H., Gesture Analysis Bow Strokes Using an Augmented Violin, Technical Report, IRCAM, Jun. 2004.

International Search Report and the Written Opinion of the International Searching Authority dated Jan. 7, 2010, International Application No. PCT/US2009/044382.

International Preliminary Report on Patentability dated Dec. 2, 2010, International Application No. PCT/US2009/044382.

* cited by examiner

*Primary Examiner* — Jeffrey Donels

(74) *Attorney, Agent, or Firm* — Weaver Austin Villeneuve & Sampson LLP

(57) ABSTRACT

A sensor bow system is described which generates various types of data representing various movements of and forces exerted upon a sensor bow intended for use with any of a variety of stringed instruments. The sensor bow data may be used to control a wide variety of audio, visual, and other effects.

20 Claims, 9 Drawing Sheets

SENSOR BOW FOR STRINGED INSTRUMENTS

RELATED APPLICATION DATA

The present application claims priority under 35 U.S.C. 119(e) to U.S. Provisional Patent Application No. 61/055,087 entitled SENSOR BOW FOR STRINGED INSTRUMENTS filed on May 21, 2008, the entire disclosure of which is incorporated herein by reference for all purposes.

BACKGROUND OF THE INVENTION

The present invention relates to instrumentation of a bow intended for use with stringed instruments.

Reliable, practical stage-worthy sensor bows, i.e., bows that generate data representing, for example, movement of the bow, for the string family of instruments have not been available to experimenters, composers, and performers. Previous attempts to develop such bows have resulted in unwieldy, unreliable, and expensive bows which provide little useful information, and which, because of their heft and/or awkward appearance, are unlikely to ever be adopted by serious musicians.

SUMMARY OF THE INVENTION

According to the present invention, a sensor bow is provided for use with a stringed instrument. The sensor bow includes one or more orientation sensor systems configured to generate orientation data representing one or more orientations of the sensor bow relative to the stringed instrument. A grip sensor system is configured to generate grip pressure data representing grip pressure exerted by a user of the sensor bow on a grip sensor integrated with the bow stick. A bow hair sensor system coupled to the bow hair is configured to generate bow hair tension data representing tension of the bow hair.

According to various specific embodiments of the invention, the orientation of the sensor bow represented by the orientation data corresponds to one or more of (1) a first position of the sensor bow relative to a fingerboard of the stringed instrument in a direction perpendicular to a longitudinal axis of the fingerboard, (2) an angle of the sensor bow relative to a first axis substantially parallel to a plane of the fingerboard and perpendicular to the longitudinal axis of the fingerboard, (3) a second position of the sensor bow along the longitudinal axis of the fingerboard, (4) a first rotational position of the sensor bow about a second axis normal to the fingerboard, or (5) a second rotational position of the sensor bow about a longitudinal axis of the bow stick.

According to a specific embodiment, a sensor bow system is provided for use with a stringed instrument. The system includes a sensor bow having one or more orientation sensor systems configured to generate orientation data representing one or more orientations of the sensor bow relative to the stringed instrument. The sensor bow also includes a grip sensor system configured to generate grip pressure data representing grip pressure exerted by a user of the sensor bow on a grip sensor integrated with the bow stick, and a bow hair sensor system coupled to the bow hair and configured to generate bow hair tension data representing tension of the bow hair. An emitter assembly is configured for mounting to the stringed instrument, and includes one or more electromagnetic radiation sources configured to transmit electromagnetic radiation for detection by the one or more orientation sensor systems of the sensor bow.

According to another specific embodiment of the invention, methods and apparatus are provided for controlling a control system in conjunction with a musical performance. Sensor bow data generated by a sensor bow are received. The sensor bow data include orientation data representing one or more orientations of the sensor bow relative to a stringed instrument. The sensor bow data also include grip pressure data representing grip pressure exerted by a user of the sensor bow, and bow hair tension data representing tension of the bow hair. The orientation data, the grip pressure data, and the bow hair tension data are mapped to one or more control functions of the control system. Control information for controlling the control system is generated from the orientation data, the grip pressure data, and the bow hair tension data with reference to the one or more control functions. Operation of the control system is controlled using the control information.

A further understanding of the nature and advantages of the present invention may be realized by reference to the remaining portions of the specification and the drawings.

DETAILED DESCRIPTION OF SPECIFIC EMBODIMENTS

Reference will now be made in detail to specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the following description, specific details are set forth in order to provide a thorough understanding of the present invention. The present invention may be practiced without some or all of these specific details. In addition, well known features may not have been described in detail to avoid unnecessarily obscuring the invention.

According to various embodiments of the present invention, a sensor bow system is provided which generates various types of data representing movements of and forces exerted upon a sensor bow intended for use with any of a variety of stringed instruments. As will be described, these sensor bow data may be used to facilitate or control a wide variety of control systems.

Figure 1:
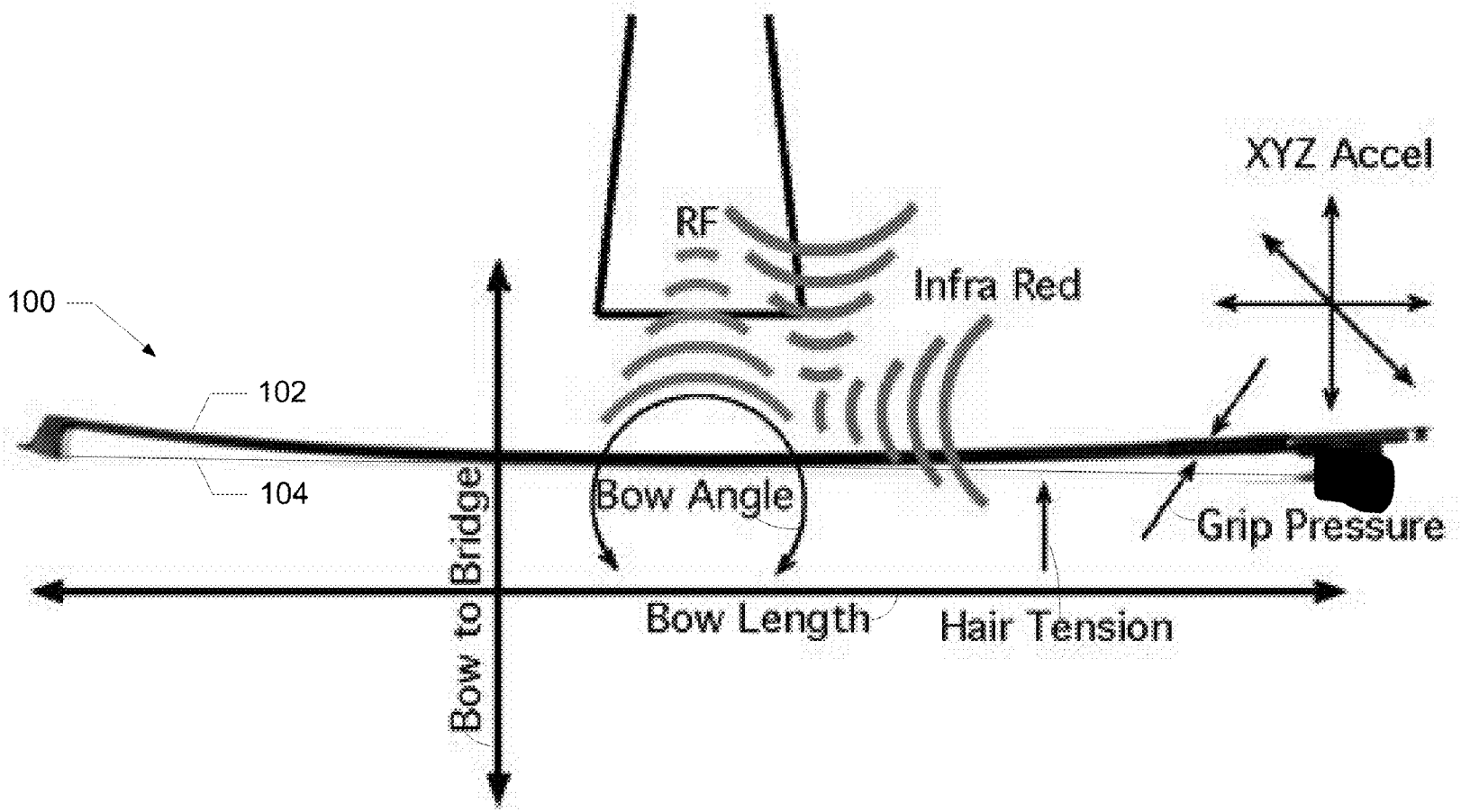
FIG. 1 is a simplified diagram illustrating various types of sensor bow data that may be generated with a sensor bow designed in accordance with a specific embodiment of the invention.
Figure 2:
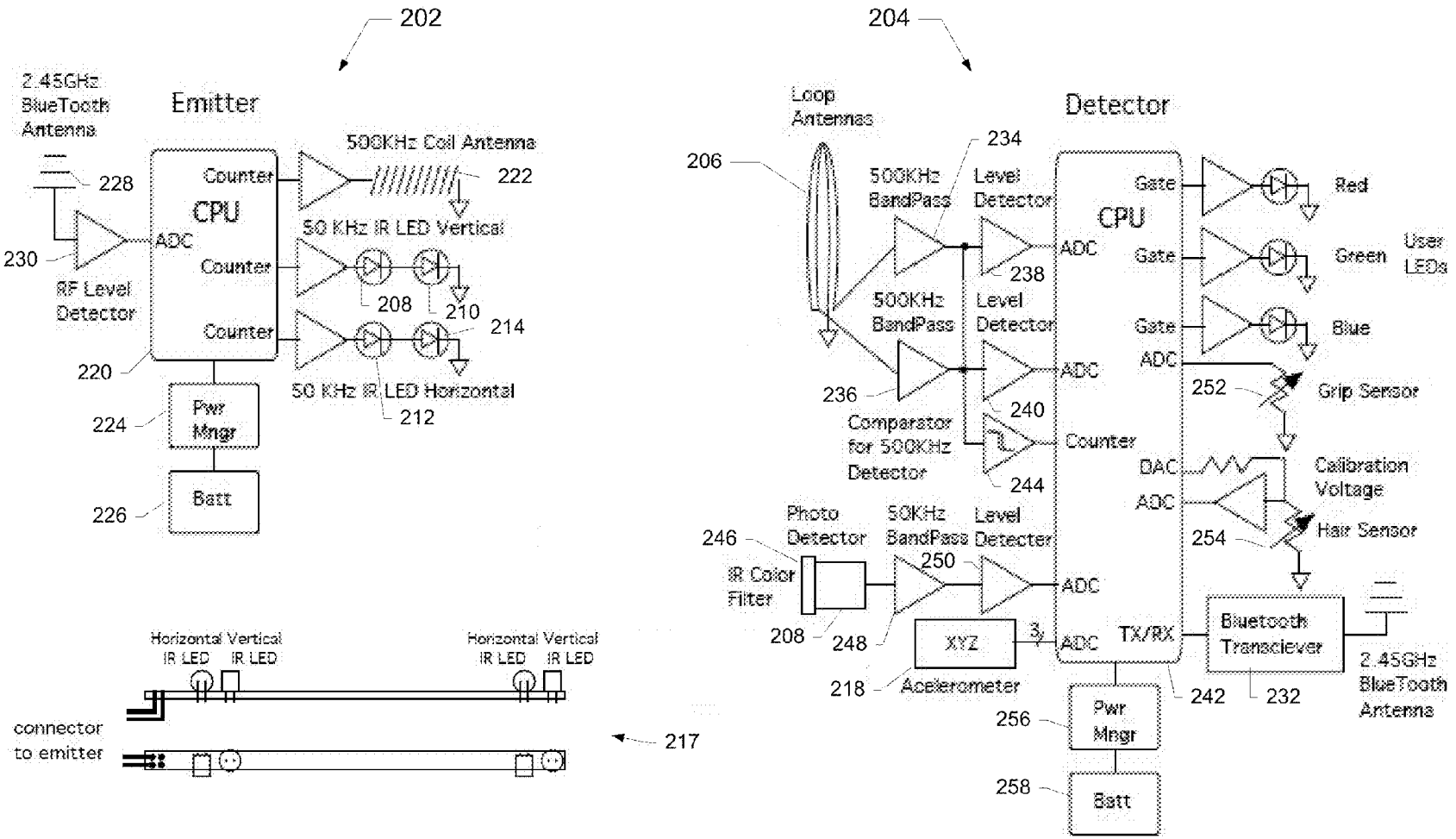
FIG. 2 is a simplified block diagram of a sensor bow system designed in accordance with a specific embodiment of the invention.

A specific embodiment of the invention will now be described with reference to FIGS. 1-9. FIG. 1 is a diagram illustrating at least some of the various types of information representing position, acceleration, force, and motion of or relating to a sensor bow 100 (collectively, sensor bow data) that may be generated in accordance with the depicted embodiment. FIG. 2 is a simplified diagram of system components that facilitate the generation of the sensor bow data. In some embodiments, emitter assembly 202 is mounted under the fingerboard of the instrument, while detector assembly 204 is integrated with sensor bow 100.

In the depicted embodiment, a representation of grip pressure is generated using a cylindrical grip sensor in the area where the musician grips sensor bow 100. As the musician exerts pressure on the grip, a changing value is generated by a grip sensor integrated with bow stick 102. A specific implementation of such a grip sensor is described below with reference to FIG. 3. Bow hair tension is represented by a measurement that is proportional to the amount of bow hair displacement as bow hair 104 is pressed onto the instrument strings.

Emitter assembly 202 emits a radio frequency (RF) signal that may be modulated in a manner that, in conjunction with detector assembly 204, facilitates generation of various types of sensor bow data. Bow 100 has two loop antennas 206 integrated into the structure of the bow stick (e.g., a Kevlar and carbon graphite stick) and running all or most of the length of the bow longitudinally. According to a specific embodiment, the antenna conductors (28 AWG wires) are woven into the fabric of the Kevlar beneath the graphite to ensure that they do not cross over each other and remain substantially straight. The loop antennas pick up the RF signal generated by emitter assembly 202 which is then used to generate some of the sensor bow data. For example, the overall amplitude of the received RF may be used to generate data representing the distance between the sensor bow and the bridge or fingerboard of the instrument. This is information is useful for both detecting the presence of the sensor bow, as well as its position along an axis parallel to the fingerboard, i.e., Bow to Bridge.

Figure 4:
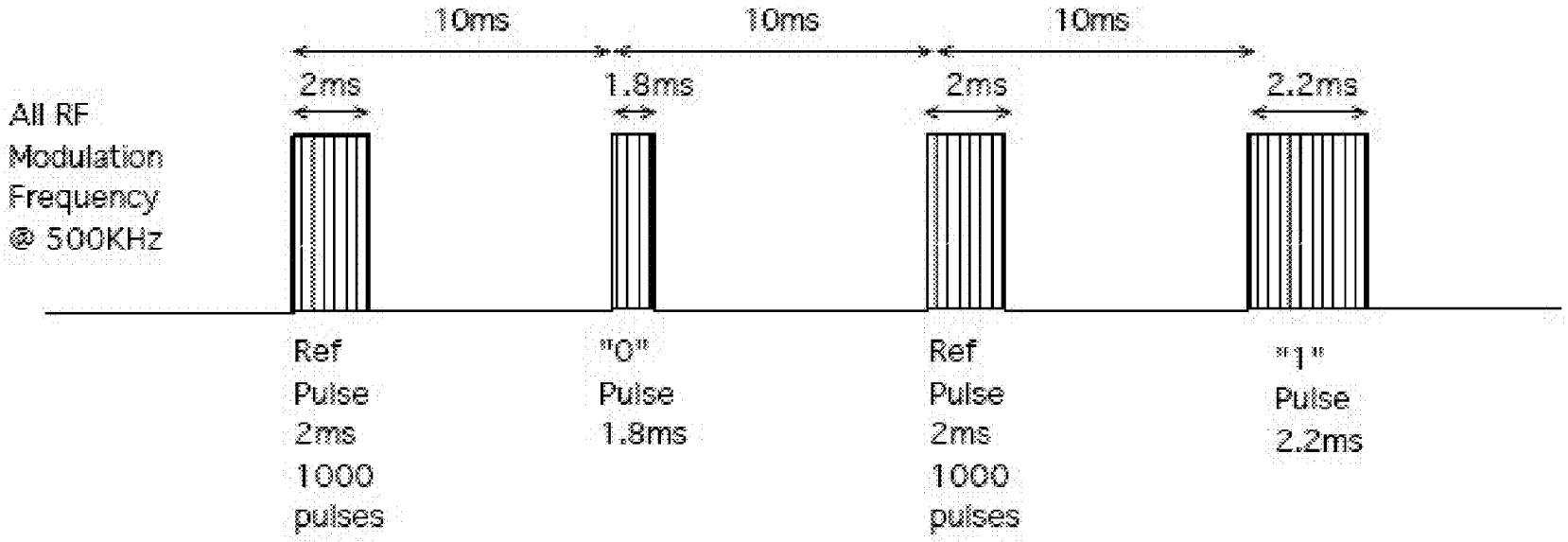
FIG. 4 is a timing diagram illustrating a modulated RF waveform according to a specific embodiment of the invention.

According to a specific embodiment, the RF signal generated by emitter assembly 202 is a 500 kHz signal that is modulated as shown in FIG. 4. An RF pulse is emitted every 10 ms. Every other pulse is a reference pulse (Ref Pulse) having a width of 2 ms (i.e., 1000 pulses). The pulses emitted between reference pulses alternate between widths of 1.8 ms (the "0" Pulse) and 2.2 ms (the "1" Pulse). As will be described, these pulses may be used to provide synchronization information for the infrared (IR) sensing mechanisms included in the system. A "flywheel" system may be employed to keep the timing during brief interruptions of reception of the RF data.

More generally, the manner in which RF pulses are modulated may provide a mechanism by which a wide variety of information may be communicated from the emitter assembly to the detector assembly. For example, data generated by any additional sensors included on the emitter assembly (e.g., an accelerometer) could be transmitted to the detector assembly via this mechanism. In the present embodiment, data representing the battery voltage powering the emitter is conveyed to the detector which then passes it to the host PC enabling the user to track remaining battery life of the emitter. The wide variety of types of information that may be transmitted in this way and the various modulation techniques that may be employed to encode such data will be understood by those of skill in the art.

According to an embodiment in which IR synchronization information is provided, emitter assembly 202 includes two pairs of IR light emitting diodes (LEDs) oriented at 90 degrees to each other, i.e., vertical LEDs 208 and 210 and horizontal LEDs 212 and 214, that alternately emit 50 kHz IR pulses; the vertical LEDs in synchronization with the RF reference pulses, and the horizontal LEDs in synchronization with the "0" and "1" pulses. A photodetector 216 that receives the IR pulses is positioned on sensor bow 100 near the grip sensor. According to a particular embodiment, the array of IR LEDs extends from and is detachable from the emitter assembly. A specific implementation of such an emitter stick assembly 217 is shown in FIG. 2 in top and side views.

Because the CPU in detector assembly 204 knows which IR LEDs are emitting at any given time (because of the known synchronization with the RF pulses), the relative intensities of the IR energy received by photodetector 216 may be used to represent Bow Angle, i.e., the angle of the sensor bow relative to an axis parallel to the fingerboard and perpendicular to the strings. That is, by comparing the square of the amplitudes of the energy received from the different pairs of LEDs, the angle of the sensor bow relative to the instrument fingerboard may be represented. The square of the overall amplitude of IR energy received from both pairs of LEDs may also be used to represent Bow Length, i.e., the position of the sensor bow relative to the fingerboard in the direction perpendicular to the fingerboard. Finally, the received IR energy may also be used to represent the rotational position of the sensor bow about an axis normal to the face of the instrument. Using a longer emitter stick (i.e., on which the IR LEDs are mounted) and further encoding the IR LEDs so the detector CPU is aware which LED is being modulated, it is possible to generate data representing angular position (yaw) relative to the strings and top plate of the instrument.

Figure 5:
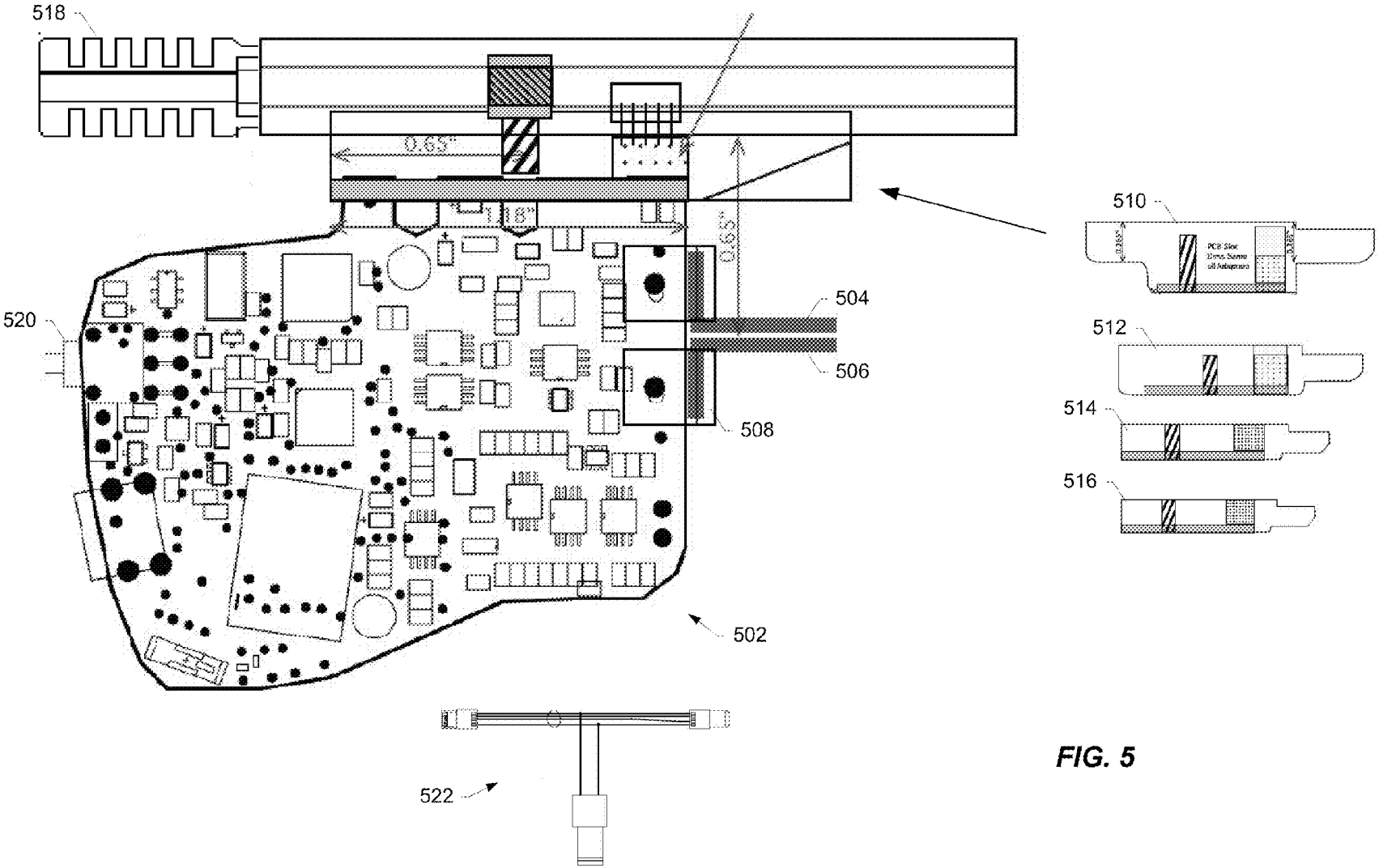
FIG. 5 is a diagram illustrating a frog assembly designed in accordance with a specific embodiment of the invention.

An XYZ accelerometer 218 is in the plane of a circuit board on which many of the components of detector assembly 204 are mounted. The circuit board (an example of which is shown in FIG. 5) is mounted to the bow stick of sensor bow in the position of the traditional bow "frog," i.e., the assembly which anchors and adjusts the near end of the bow hair. The accelerometer data may be used for a number purposes. For example, these data may be used to detect transitions, for triggers (e.g., when the bow changes directions), to represent movements of the sensor bow (e.g., tilt or twist), etc. As another example, these data may be used to create and store "gestures" that may be recognized by software or devices controlled by or being used in conjunction with the sensor bow, e.g., movement of the bow by the musician tracing alphanumeric characters in the air. According to a specific embodiment, the x, y, and z data are combined to represent a total amount of bow motion, which is mapped to any of a variety of parameters, e.g., amount of delay, and used to create a wide variety of audio effects. Embodiments are also contemplated in which acceleration data are generated in fewer than three dimensions. Even data relating to only a single dimension can be useful to enable some of the contemplated functionalities.

Emitter assembly 202 includes a central processing unit (CPU) 220 which may be configured to perform a variety of functions. As will be understood, CPU 220 may be implemented using any of a wide variety of data processing or computing devices without departing from the scope of the invention. Emitter assembly is preferably thin enough to be mounted underneath the near end of the instrument fingerboard without touching the body of the instrument.

CPU 220 generates and modulates the 500 kHz RF signal driving coil antenna 222 via a power amplifier. CPU 220 also generates the 50 kHz drive for the vertical and horizontal IR LEDs. CPU 220 is also configured to implement power management functions (represented by block 224). According to one embodiment, CPU 220 senses the "health" of battery 226 and sends corresponding information (e.g., remaining battery life) to detector assembly 204 encoded in the modulated RF signal as mentioned above.

Emitter assembly 202 also includes a Bluetooth antenna 228 and RF level detector 230, the output of which is converted from an analog to a digital signal and used by CPU 220 to detect the presence of a Bluetooth transmitter, e.g., Bluetooth transceiver 232 of detector assembly 204, and therefore the presence of a sensor bow 100. If the presence of a sensor bow (and in some embodiments, the movement of a sensor bow) is not detected for user adjustable period of time, CPU 220 places emitter assembly 202 in a sleep state to conserve power. After a longer user adjustable period of time without detection of a bow, CPU 220 turns emitter assembly 202 off.

Figure 3:
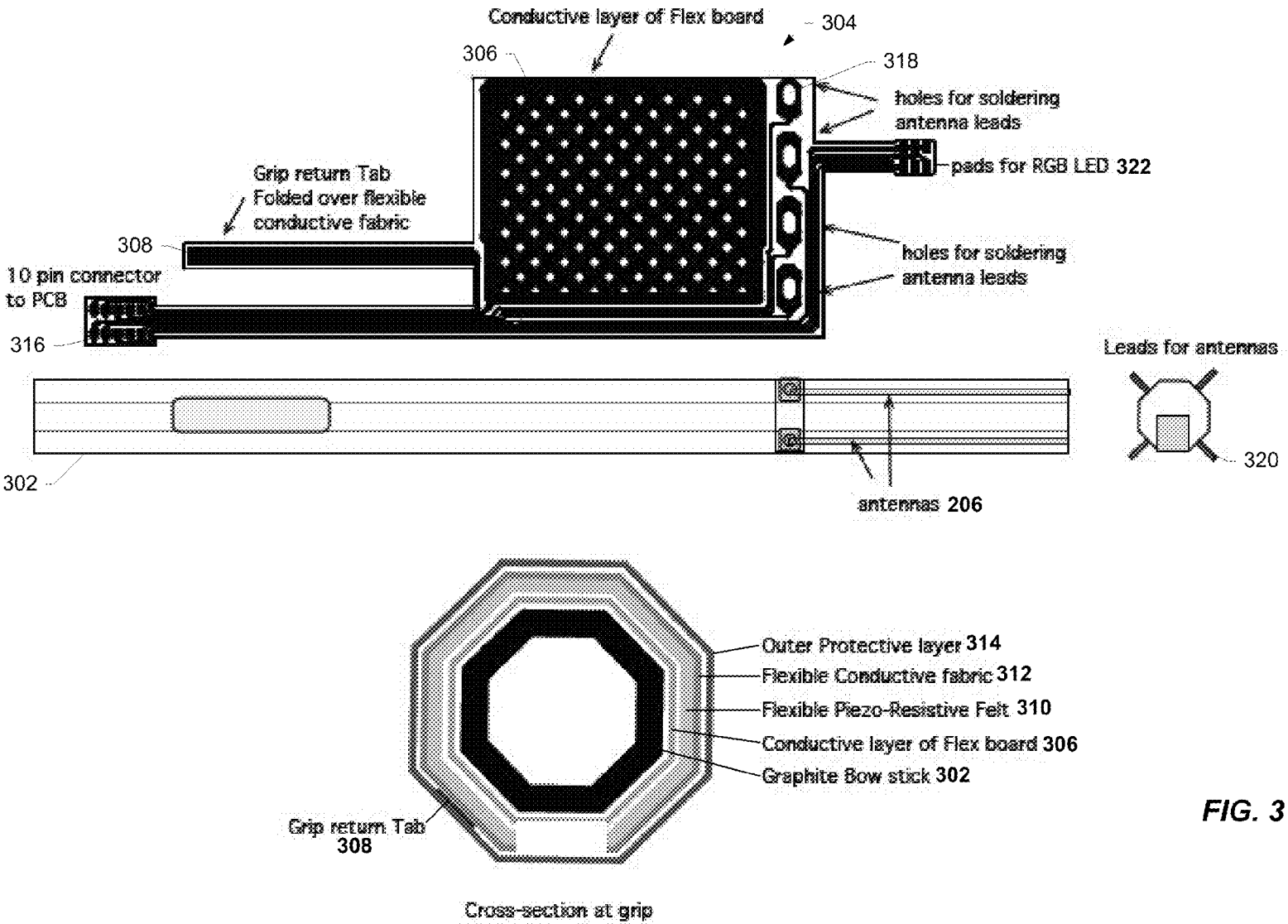
FIG. 3 is a diagram illustrating construction of a grip sensor according to a specific embodiment of the invention.

Referring now to detector assembly 204, the two loop antennas 206 are implemented using a single conductor with a center tap, with the two loops being deployed along the length of the bow stick at 90 degrees to each other as depicted in FIG. 3. The two antennas may be implemented using separate conductors, but it was found that tapping the single conductor in this way improved performance. Each of the tapped points (one for each loop) is passed through a high gain (e.g., 48 dB), high Q (e.g., 20) band pass filter (234 or 236) centered at 500 kHz and a level detector (238 or 240), the output of which varies from about 0 to 2.5 volts. This signal is then converted from analog to digital for use by CPU 242 which, like CPU 220, may be implemented using any of a wide variety of data processing or computing devices. According to some embodiments, the sensitivity of level detectors 238 and 240 is in the millivolt range to provide a higher degree of precision in the sensor bow data. The antenna configurations for bass and cello would be opposite those for violin and viola since they are bowed from different sides.

The sum of the recovered 500 kHz sinusoid from band pass filters 234 and 236 is also provided as input to a comparator 244 which changes state each time the recovered sinusoid completes a cycle; effectively counting the number of completed cycles. This information is used by CPU 242 to distinguish between reference pulses, "0" pulses, and "1" pulses in the received RF energy. The output of comparator 244 is also used to sense the proximity of the sensor bow to the instrument. Comparator 244 is implemented with hysteresis to keep the circuit generally quiet in the absence of the 500 KHz emitter signal when the sensor bow is not near the instrument. When this condition (i.e., the loss of RF lock) occurs, the counting of cycles will stop, and either the host PC or CPU 242 "freezes" the information generated when the sensor bow is in proximity to the instrument in it last known good state. It should be noted that embodiments are contemplated in which just one detector input is provide to the comparator.

According to a particular implementation, both loops of the antenna provide input to separate RF comparators. The phase of the transitions of the two comparators are compared to each other. From this information, data are generated that represent the twist or roll of the sensor bow with respect to the RF coil in the emitter.

The IR energy transmitted by the horizontal and vertical LEDs on the emitter assembly are picked up by photodetector 216 after first passing through an IR color filter 246 which is tuned to the wavelength of the IR energy (e.g., 895 nm). This filter prevents ambient light from swamping the detector. The signal from the detector is passed through a high gain (e.g., 48 dB), high Q (e.g., 20) band pass filter 248 centered at 50 kHz, and a level detector 250. The output of level detector 250 is then converted from analog to digital for use by CPU 242.

As mentioned above, the square of the total energy received is used to represent the Bow Length, i.e., the position of the sensor bow relative to the fingerboard in the direction perpendicular to the fingerboard. That is, because photodetector 216 is positioned at the near end of the sensor bow, e.g., on the frog, the amount of energy received by the photodetector is proportional to the distance from the emitter assembly squared, and is therefore representative of the positioning of the sensor bow relative to the fingerboard in this direction. And as mentioned above, the synchronization information embedded in the RF energy captured by loop antennas 206 is used by CPU 242 to distinguish between vertical and horizontal sources of the IR energy, and therefore to calculate a representation of the angle or tilt (pitch) of the bow relative to the instrument.

It is possible that photodetector 216 falls below the "horizon" of the IR LEDs on the emitter assembly causing a temporary loss of the information necessary to generate the data representing Bow Angle and Bow Length, i.e., because the photodetector is below the strings, the bow can be tilted so the violin itself interrupts the line of sight between the IR LEDs and the detector. It is possible to use these stable positional data to frequently calibrate XYZ accelerometer 218 for brief useful periods while the IR energy is not visible. According to a specific embodiment, the photodetector is disposed on the frog assembly to mitigate this issue.

Accelerometer 218 may be any of a wide variety of commercially available MEMS accelerometers. According to a specific implementation, accelerometer 218 is settable in 1.5 g increments up to 6 g.

Detector assembly 204 also includes red, green, and blue LEDs which may be used to provide any of a wide variety of feedback to the musician regarding the state of operation of any of the system components. Embodiments are contemplated in which other types of displays and/or output devices may be provided instead of or in addition to these LEDs to provide visual feedback. According to a specific embodiment, one or more lasers may be provided on the detector assembly to generate visual effects.

As mentioned above, a grip sensor 252 integrated into the bow stick provides information to CPU 242 regarding how tightly the musician is gripping the sensor bow. In the implementation illustrated in FIG. 3, graphite and Kevlar bow stick 302 with integrated loop antennas 206 is surrounded by Flex board 304. Flex board 304 includes a conductive layer 306 and a return tab 308 which form a circuit with intervening layers of flexible piezo-resistive felt 310 and flexible conductive fabric 312. As pressure is exerted on the outer protective layer 314, the resistance of felt layer 310 changes which is sensed by CPU 242 via conductors connected to layer 306 and return tab 308 and 10-pin connector 316. Flex board 304 includes holes (e.g., 318) for soldering to the antenna leads (e.g., 320) and conductors which bring these signals to connector 316. CPU 242 also provides drive signals to the red, green, and blue LEDs on the bow stick via conductors on Flex board 304 and pads 322.

Referring back to FIG. 2, a bow hair sensor 254 provides information to CPU 242 representative of tension on the bow hair of the sensor bow. In a particular implementation shown in FIG. 5, this information is captured using mechanical components including a piezo-resistive material. FIG. 5 shows a side view of a circuit board 502 on which many of the components of a detector assembly designed in accordance with a specific embodiment of the invention (e.g., detector assembly 204) are integrated. As shown, circuit board 502 is, itself, the primary mechanical component which performs the function of the traditional frog, i.e., anchors the near end of the bow hair. The bow hair (not shown) are sandwiched and secured between two L-brackets 504 and 506. The two L-brackets are, in turn, secured within bracket 508 such that the right hand faces of the vertical portions of each L-bracket are forced toward the right hand inner surface of bracket 508 by the bow hair tension. Bracket 508 is mechanically and rigidly secured to circuit board 502.

A piezo-resistive element, e.g., a force sensing resistor or FSR, is inserted between the inner surface of bracket 508 and the right hand face of the vertical portion of the lower L-bracket 506. As the musician presses the bow hair down onto the strings of the instrument, this exerts an upward force on the horizontal portion of L-bracket 506, which translates to a lateral force on the piezo-resistive element sandwiched between the L-bracket and the inner surface of bracket 508. The resulting signal, which is representative of the bow hair tension, is provided to CPU 242.

According to a particular class of embodiments, circuit board 502 may be employed with virtually any size bow with the use of some adaptive components. The primary adaptive component is a slider assembly by which circuit board 502 is secured to the bow stick. Four different variations of a slider components are shown in FIG. 5, for use with a violin (516), a viola (514), and cello (512), and a bass (510). Each of these slider assemblies is designed to give the musician the feel of a traditional bow. Note how the narrower portion of the slider mimics the ergonomics of the grip of a traditional bow.

Another example of an adaptive component are L-brackets 504 and 506. That is, the width (into the page) of L-brackets 504 and 506 may be varied to accommodate the different width bow hair ribbons for different size bows. However, as will be understood, as long as the width of these brackets can accommodate the widest ribbon, these components can remain the same and still support using the same assembly for different instruments.

An important advantage of the basic configuration illustrated in FIG. 5 is derived from the fact that circuit board 502 is both the primary mechanical component securing the near end of the bow hair, and the substrate on which many of the detector assembly components reside. Without this dual use, an additional (likely more traditional) mechanical component would be required to transfer the tension of the bow hair to the bow stick. This would result in the overall weight of the bow being unacceptable to most serious musicians. With this innovation, sensor bows are enabled which are well within the acceptable range of weights of traditional bows.

Another optional innovation is represented in FIG. 5 by bow stick termination screw 518 (shown in cross-section). This extremely lightweight termination screw (e.g., titanium) extends beyond the edge of the frog assembly casing (not shown) enclosing circuit board 502 in a manner which protects the frog assembly, and particularly power switch 520, from undesirable mechanical contact.

CPU 242 is also configured to implement power management functions as represented by block 256. For example, if the sensor bow is sitting idle for some user adjustable period of time (as determined, for example, from the output of accelerometer 218), CPU 242 places detector assembly 204 in a sleep state to conserve power. After a longer user adjustable period of time without detection of bow movement, CPU 242 turns detector assembly 204 off.

Programming updates, e.g., firmware updates, may be sent to the detector assembly in the sensor bow via the Bluetooth transceiver. According to a particular implementation, the firmware image is less than half the size of the available FLASH memory associated with the detector CPU so an entire new image can be uploaded and verified before switching operation of the assembly over to the new firmware. In addition, in response to any problems running the new firmware, the detector CPU automatically reverts to the previous image. By contrast, the CPU in the emitter assembly has no direct communication link to the host computer. CPU 242 and CPU 220 can also be programmed by a 2 wire interface. Therefore, a special crossover cable (e.g., 522) and an unused USB pin allows a new emitter firmware image to loaded to the K-Bow where it is transferred to the emitter via this special cable.

Every 10 ms, CPU 242 assembles all of the collected information into a packet which is transmitted to a nearby Bluetooth-enabled computing device (e.g., by Bluetooth transceiver 232) for use in any of a wide variety of ways, examples of which are described below. According to a specific embodiment, the sensor bow data are formatted into a minimum-size Bluetooth packet of 27 bytes designed to efficiently balance latency, throughput, and power use. Most of the individual components of the sensor bow data (e.g., Bow Length, Bow to Bridge, Bow Angle, Hair Tension, Grip Pressure, etc.) are represented with 16 bits. The remaining battery levels for the batteries in both the emitter and detector assemblies (e.g., batteries 226 and 258) are 8-bit values. Also included is a 16-bit CRC value, and a packet sequence number so that the receiving software can determine whether any packets are dropped.

Sensor bow data generated in accordance with the various embodiments of the invention may be employed in a wide variety of ways. That is, the data generated by a sensor bow system designed in accordance with an embodiment of the invention may be employed in myriad ways to achieve a virtually limitless range of aesthetic, educational, and technical effects. Examples of such applications include the ability to manipulate pre-recorded sound by taking the data representing bow movements and interaction of the bow with the user and the instrument and mapping the data to various audio effects. Movements of a sensor bow could be used in the context of recording as recording cues to trigger and/or control various processes. In embodiments which are able to track the position of the end of the bow relative to the fingerboard, different portions of the bow hair may be assigned different effects. For example, if the instrument is being used to control various synthesizer sounds, different sections of the bow hair could be assigned to emulate different instruments.

Position and movement of a sensor bow can be mapped to produce different effects, e.g., brightness. Bow movements can be mapped to a character recognition process which may, in turn, be used to control any of a wide variety of processes. Traditional formal bow techniques can be recognized from bow movements, and that information can be used in a wide variety of traditional and non-traditional ways. For example, the ability to detect bow position and movement and provide feedback can be the basis for a wide range of training and pedagogical applications as well as for inserting bow movement techniques, such as upbow, downbow, Spicatto, etc., into notation for sheet music. Feedback based on the data generated by the sensor bow can also be used during performance, e.g., to provide rhythmic information, and/or to communicate the state of ongoing processes, e.g. recording or other audio signal processing. The grip pressure data can also be mapped to a wide variety of different effects, e.g., to control a resonant filter or create effects similar to a "wah" pedal. As will be understood, the possible applications are virtually unlimited.

The following description relates to one set of applications referred to as K-Apps which provide the musician with a wide range of tools and interfaces to map the various sensor bow data to various audio and visual effects. As will be discussed, the sensor bow data may be used by K-Apps as control information to achieve such effects. In addition, embodiments are contemplated in which the sensor bow data are also provided as output in any of a variety of standard or proprietary formats for use as control information by third-party software. According to a specific embodiment discussed below, the sensor bow data are encoded using the Musical Instrument Digital Interface (MIDI) format. According to another specific embodiment, the sensor bow data are encoded using the Open Sound Control (OSC) protocol over Ethernet which allows directing the data to an Ethernet address and port number.

Figure 6:
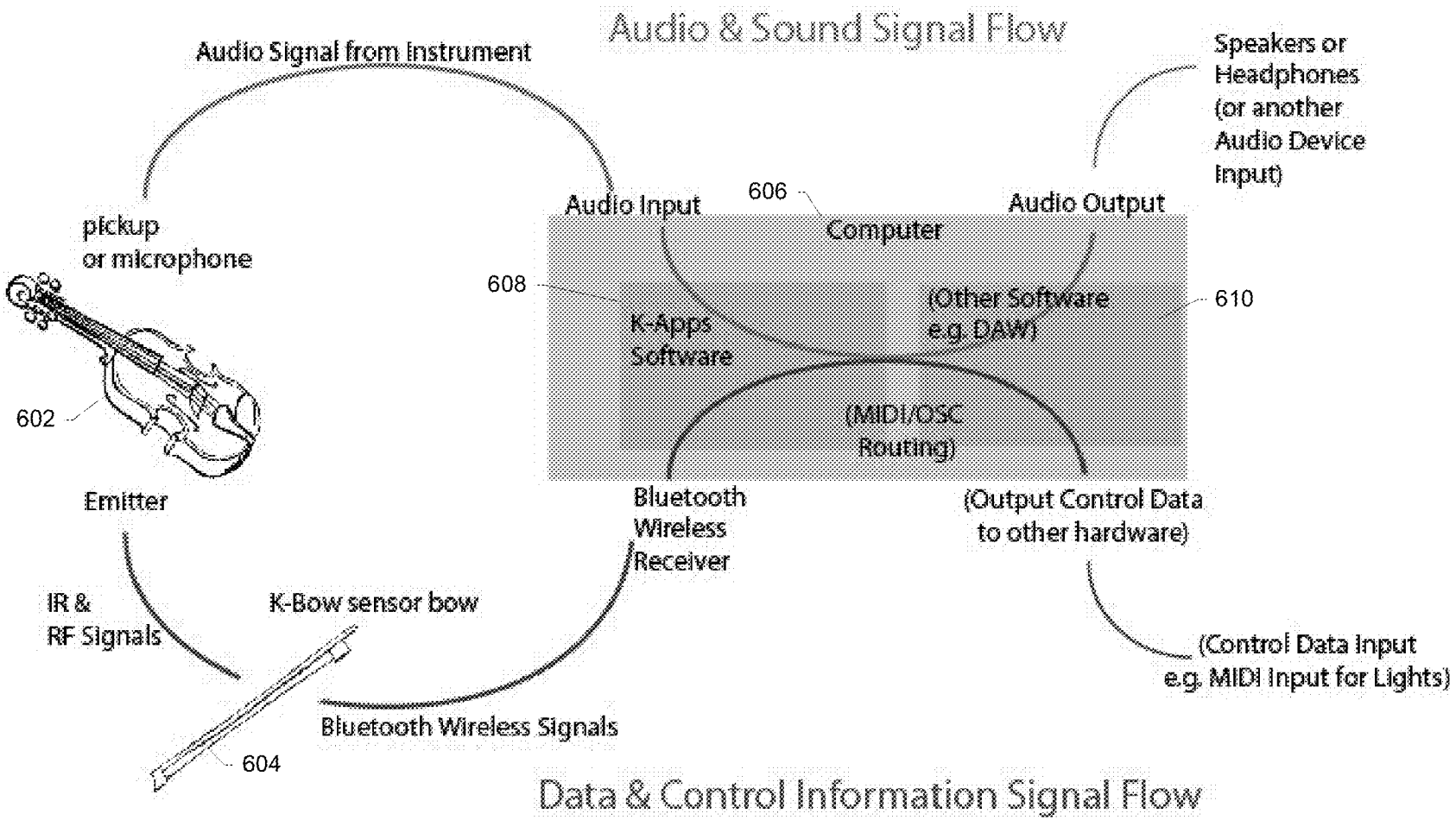
FIG. 6 is a simplified diagram illustrating the flow of audio and control information from an instrument and sensor bow to a computing device in accordance with a specific embodiment of the invention.

FIG. 6 illustrates the flow of audio and control information from an instrument 602 and sensor bow 604 to a computing device 606 (e.g., a laptop or desktop computer) and the K-Apps software 608 running on device 606 alongside additional software 610. As will be understood, the nature and type of the computer program instructions implementing software 608 and 610 may vary considerably without departing from the invention. That is, these computer program instructions with which embodiments of the invention are implemented may be stored in any type of computer-readable storage media, and may be executed according to a variety of computing models including a client/server model, a peer-to-peer model, on a stand-alone computing device, or according to a distributed computing model in which various of the functionalities described herein may be effected or employed at different locations. Similarly, computing device 606 may represent any of a wide variety of computing devices including individual computing platforms as well as multiple interconnected devices. Therefore, the scope of the present invention should not be limited by references herein to specific types of computing devices, software, programming languages, or data formats.

Referring again to FIG. 6, an audio signal from instrument 602 is received as audio input by computing device 606 and provided to K-Apps software 608. This audio signal (which may be in analog or digital form) represents the music being generated by instrument 602 and may be provided using any of a wide variety of conventional mechanisms, e.g., acoustic pickups, electric instrument outputs, etc. Sensor bow 604 (in conjunction with an emitter assembly mounted on instrument 602) generates and transmits sensor bow data to a receiver associated with computing device 606 as described above.

As will be described below, the various types of sensor bow data are used by K-Apps software 608 as control information for processing and manipulating the audio signal coming from instrument 602, as well as other signals or systems. At least some of the control information generated from the sensor bow data may be formatted using standard formats or protocols (e.g., MIDI or OSC) and then passed to additional software 610 on computing device 606 such as, for example, audio software for generating an audio output provided to speakers or headphones (not shown). Alternatively, the sensor bow data may be output to external hardware (not shown) as, for example, a MIDI input to a lighting control system. As will be understood, these are merely examples. The uses to which sensor bow data generated in accordance with the invention may be put are virtually limitless.

Figure 7:
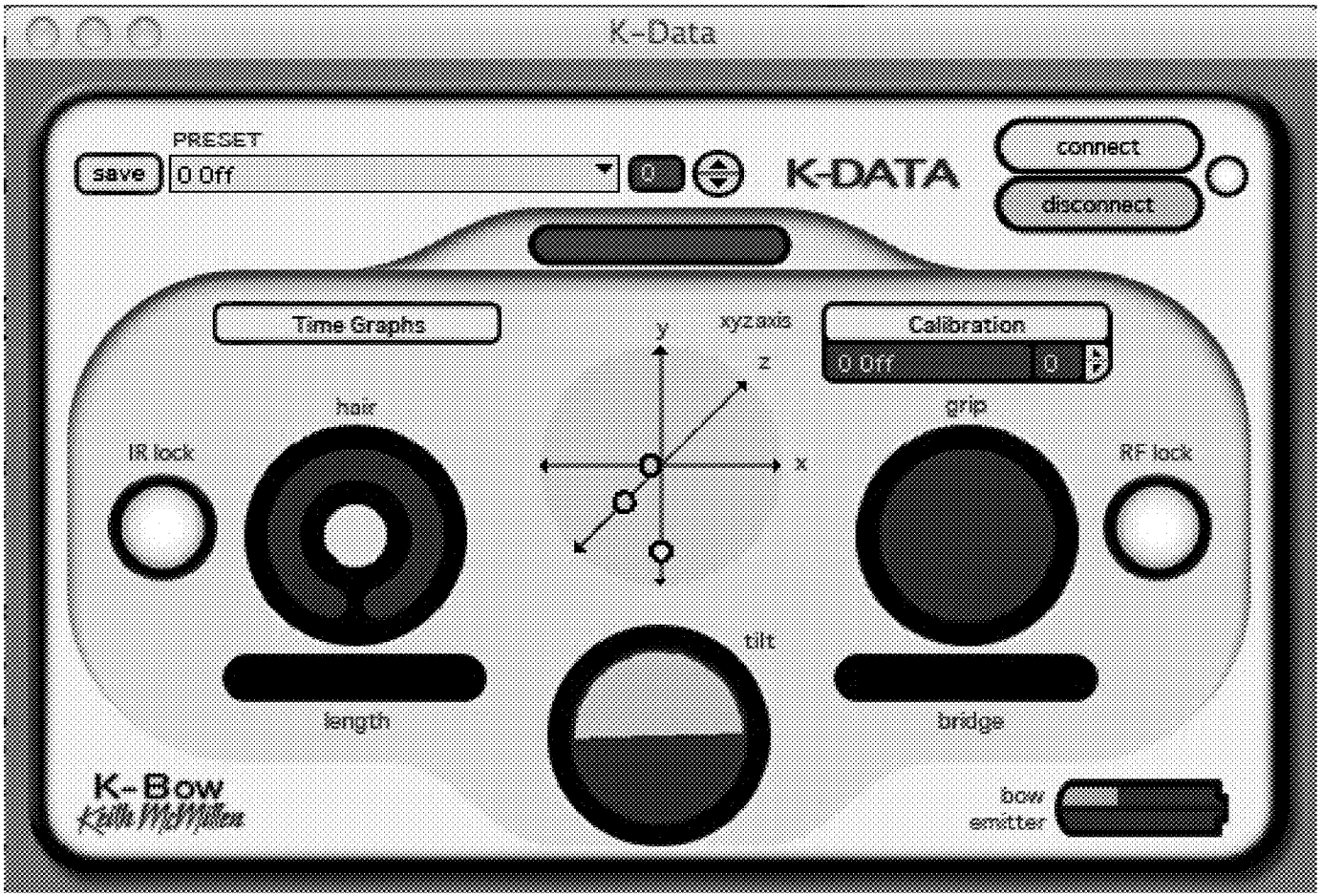
FIG. 7 is an example of an interface presenting visual representations of various types of sensor bow data generated in accordance with a specific embodiment of the invention.

According to a specific embodiment, the K-Apps software provides a K-DATA interface as shown in FIG. 7 which provides the user with a visual representation of the current state of the various types of sensor bow data. The range of values depicted for each type of sensor bow data may be calibrated by the user using either manual or automatic calibration processes. During calibration, the user or the automated process selects each type of sensor bow data in succession, and provides or prompts the user to provide the maximum and minimum values by, for example, moving the sensor bow in various axes or by squeezing the bow grip. These values are then used to represent the full scale for each of the data types. According to a manual calibration procedure, the user is required to hold the sensor bow in 11 unique positions while interacting with the interface on the computer to indicate the minimum and maximum values. Because this can be difficult to do while holding a violin and a bow, another calibration technique uses text-to-speech voice synthesis to talk the user through the calibration process. The user follows the text-to-speech instructions, holding the bow in a specific way for a few seconds while the computer gathers data. Once the computer receives a stable in bounds value for each bow parameter, it moves on to the next calibration value.

Figure 8:
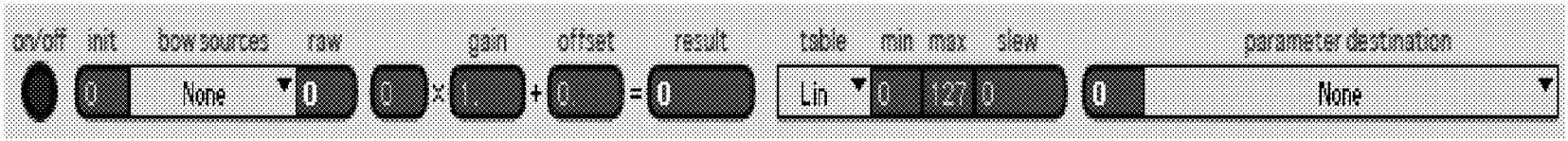
FIG. 8 is an example of an interface by which a user can map a particular type of sensor bow data to a destination parameter in accordance with a specific embodiment of the invention.

Once the system is calibrated, the various types of sensor bow data may be mapped to a virtually limitless range of parameter destinations using a modulation line interface such as the one shown in FIG. 8. The modulation line interface depicted may be accessed from a number of different interfaces generated by K-Apps and includes the following options. The on/off control enables and disables the modulation line. An init field allows the user to manually specify an initial value for the particular type of sensor bow data which is the starting value in the absence of any raw data from the sensor bow.

The bow sources field enables the user to select the type of sensor bow data that will be the control information for this modulation line. Examples of various types of sensor bow data include XYZ accelerometer (in any one or a combination of the 3 axes), Hair Tension, Grip Pressure, Bow Length, Bow to Bridge, Bow Angle or Tilt, Up Bow (i.e., raising the bow), Down Bow (i.e., lowering the bow), Smooth Speed, Fast Speed, IR Lock, RF Lock, etc. The raw field represents the raw values coming from the selected bow source.

The gain field allows the user to specify a gain value for modifying the signal selected in the parameter destination field. Whatever number is entered in this field is multiplied by the value in the init field. For example, if the parameter destination is a pitch speed control, clicking on the gain window and entering the value "2" will double the speed of the pitch for every value received from the bow source. A value of "−3" will have the opposite effect, and will either slow down the playback speed or even reverse it. The offset field enables the user to specify an offset value.

The result field shows the resulting value of the selections made. This value is applied to a table selected in the table field. Shapes other than linear mapping of bow sensor data to an effect may be desirable. For example while panning between two audio sources a linear response (such as length of bow to violin) produces a 6 dB decrease in perceived loudness at the middle of the pan. Using an exponential table shapes the linear input from bow position so that there is equal energy at all points along the bows travel. Therefore, each table corresponds to a different type of response (e.g., linear vs. logarithmic). If the result value is within the range of min and max values of the table, it is mapped to a table value which is then modified by the value specified in the slew field before finally impacting the parameter specified in the parameter destination field.

The min field specifies the minimum value of the selected type of sensor bow data that will affect the range, or at what bow source value the corresponding effect will be triggered or modulate the parameter. The max field specifies the maximum value of sensor bow data or the highest range of value that will have an effect on the parameter destination. The slew field value affects the speed at which the modulation fades in or fades out. The larger the slew, the more slowly the effect will respond to the bow source. This is similar to the attack or release parameters found in other music technology.

The parameter destination field allows the user to specify the parameter or effect to which the modulation line corresponds, i.e., the parameter being modified by the selected sensor bow data. Examples of the options that might be presented here include delay time, filter center frequency, audio playback speed and pitch, sound location in an array of loudspeakers, or any audio parameter. Video processing applications will be controlled in a similar manner where a source such as bow tilt can control destinations such as the red balance, pixilation, or zoom of a video image.

One simple way of illustrating the effect of a modulation line is the algebraic representation of a line on an x-y plane, i.e., $y=mx+b$. In this case, the modulation "line" would be represented as (result)=(gain)×(init or bow source value)+(offset). The selected table further impacts what numbers are plotted for "x" (i.e., the init or bow source value) and "y" (i.e., the result). If the (result) value is within the range <min, max> then it will be applied to the specified parameter destination. However, you also have to take time into consideration. The slew rate will determine how quickly or slowly the value will be applied to the parameter.

Figure 9:
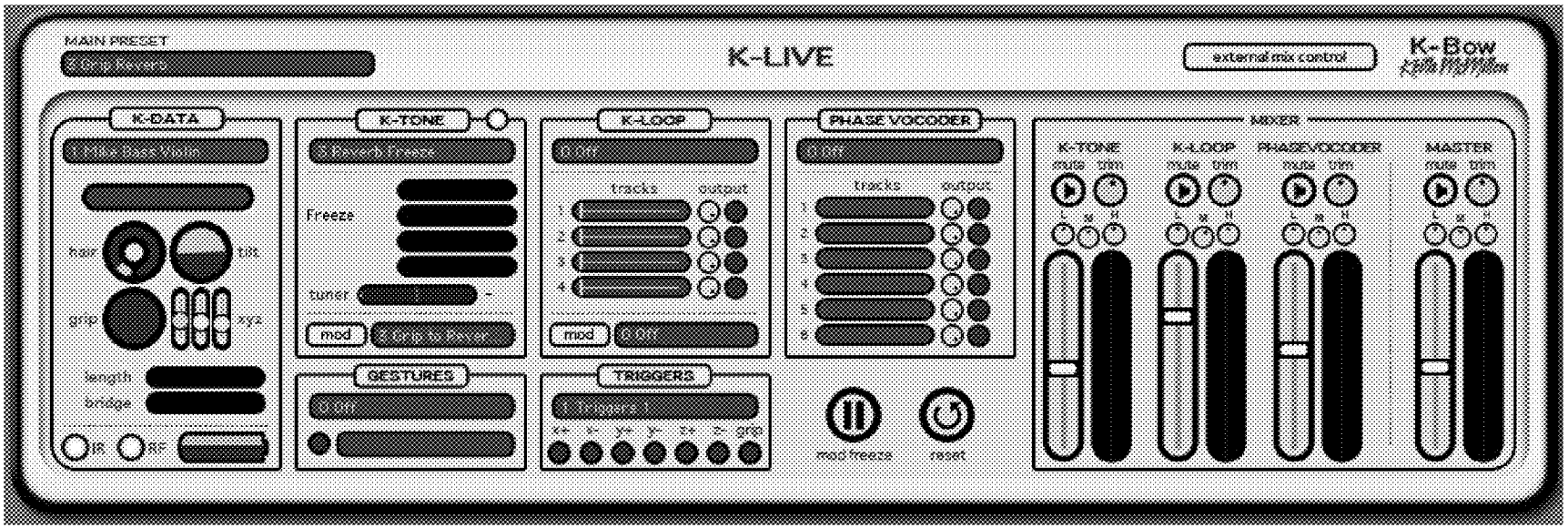
FIG. 9 is an example of an interface designed according to a specific embodiment of the invention by which a musician may create, track, and manage information relating to a sensor bow during a live performance.

FIG. 9 depicts a K-LIVE interface which is a single window allowing the user to view simultaneously what is happening in multiple applications within K-Apps. It is intended for use during a live performance when a performer will not typically have time to search through multiple windows. In this particular example, the interface (which is configurable by the user) includes a scaled-down version of the K-DATA interface of FIG. 7 alongside a K-TONE interface, a GESTURES interface, a K-LOOP interface, a TRIGGERS interface, a PHASE VOCODER interface, and a MIXER interface.

The K-TONE interface allows the user to take advantage of any of a variety of standard signal processing functions (e.g., compressor, gate, limiter, basic and parametric equalizers, pitch shift, filters, audio modulation (vibrato, flanger, chorus, ring mod), amp simulators, delays, reverbs, tuners, pre and post gain/volume levels, etc.) to enhance the basic sound of the instrument, or to control and modulate these parameters for effect during performance.

The GESTURES interface relates to the ability to train the sensor bow system to recognize gestures and map them to various controls or effects. The K-LOOP interface allows the user to create and manage audio loops. The TRIGGERS interface allows the user to create and manage triggers controlled by the sensor bow. The PHASE VOCODER interface makes it possible to control specific audio files using modulation parameters of the sensor bow. The MIXER interface allows the user to mix the output or effects associated with multiple K-Apps applications in a manner similar to a conventional mixer. It will be understood that the depicted K-LIVE interface is merely an example of the various types of information that may be provided to the live performer.

While the invention has been particularly shown and described with reference to specific embodiments thereof, it will be understood by those skilled in the art that changes in the form and details of the disclosed embodiments may be made without departing from the spirit or scope of the invention. For example, particular implementations have been described herein which employ CPU-based data acquisition techniques. The operation of particular implementations of the code which governs the operation of these CPUs may be understood with reference to the discussion above. Such code may be stored in physical memory or any suitable storage medium associated with the CPUs, as software or firmware, as understood by those of skill in the art. However, it should be noted that the use of a CPU or similar device is not necessary to implement the invention. That is, at least some of the functionality described herein may be implemented using alternative technologies without departing from the scope of the invention. For example, embodiments are contemplated which implement such functionalities using programmable or application specific logic devices, e.g., PLDs, FPGAs, ASICs, etc. Alternatively, analog circuits and components may be employed. As yet another alternative, at least some functionality may be implemented using mechanical components. These and other variations, as well as various combinations thereof, are within the knowledge of those of skill in the art, and are therefore within the scope of the present invention.

Finally, although various advantages, aspects, and objects of the present invention have been discussed herein with reference to various embodiments, it will be understood that the scope of the invention should not be limited by reference to such advantages, aspects, and objects. Rather, the scope of the invention should be determined with reference to the appended claims.

What is claimed is:

1. A sensor bow for use with a stringed instrument, the sensor bow comprising a bow stick and bow hair, the sensor bow further comprising one or more orientation sensor systems configured to generate orientation data representing one or more orientations of the sensor bow relative to the stringed instrument, a grip sensor system configured to generate grip pressure data representing grip pressure exerted by a user of the sensor bow on a grip sensor integrated with the bow stick, and a bow hair sensor system coupled to the bow hair and configured to generate bow hair tension data representing tension of the bow hair.

2. The sensor bow of claim 1 wherein the orientation of the sensor bow represented by the orientation data corresponds to a position of the sensor bow relative to a fingerboard of the stringed instrument in a direction perpendicular to a longitudinal axis of the fingerboard.

3. The sensor bow of claim 1 wherein the orientation of the sensor bow represented by the orientation data corresponds to an angle of the sensor bow relative to an axis substantially parallel to a plane of a fingerboard of the stringed instrument and perpendicular to a longitudinal axis of the fingerboard.

4. The sensor bow of claim 1 wherein the orientation of the sensor bow represented by the orientation data corresponds to a position of the sensor bow relative to a fingerboard of the stringed instrument along a longitudinal axis of the fingerboard.

5. The sensor bow of claim 1 wherein the orientation of the sensor bow represented by the orientation data corresponds to a rotational position of the sensor bow about an axis normal to a fingerboard of the instrument.

6. The sensor bow of claim 1 wherein the orientation of the sensor bow represented by the orientation data corresponds to a rotational position of the sensor bow about a longitudinal axis of the bow stick.

7. The sensor bow of claim 1 wherein the one or more orientation sensor systems comprises an infrared photodetector configured to detect infrared energy from an array of infrared light emitting diodes associated with the stringed instrument, and a pair of loop antennas configured to detect radio frequency energy from a radio frequency source associated with the stringed instrument, the loop antennas being integrated with the bow stick and oriented at 90 degrees to each other.

8. The sensor bow of claim 1 further comprising a wireless transmitter configured to transmit the orientation data, the grip pressure data, and the bow hair tension data to a wireless receiver associated with a computing device.

9. The sensor bow of claim 1 further comprising a movement sensor system configured to generate movement data representing movement of the bow in one or more dimensions.

10. The sensor bow of claim 1 wherein the grip sensor includes a piezo-resistive material wrapped at least partially around the bow stick.

11. The sensor bow of claim 1 wherein the bow hair sensor system comprises an electro-mechanical assembly including a mechanical member secured to one end of the bow hair and a piezo-resistive material, wherein the mechanical member translates bow hair tension to a mechanical force on the piezo-resistive material.

12. A sensor bow system for use with a stringed instrument, the system comprising:

a sensor bow including a bow stick and bow hair, the sensor bow further comprising one or more orientation sensor systems configured to generate orientation data representing one or more orientations of the sensor bow relative to the stringed instrument, a grip sensor system configured to generate grip pressure data representing grip pressure exerted by a user of the sensor bow on a grip sensor integrated with the bow stick, and a bow hair sensor system coupled to the bow hair and configured to generate bow hair tension data representing tension of the bow hair; and an emitter assembly configured for mounting to the stringed instrument, the emitter assembly including one or more electromagnetic radiation sources configured to transmit electromagnetic radiation for detection by the one or more orientation sensor systems of the sensor bow.

13. The sensor bow system of claim 12 wherein the orientation of the sensor bow represented by the orientation data corresponds to one or more of (1) a first position of the sensor bow relative to a fingerboard of the stringed instrument in a direction perpendicular to a longitudinal axis of the fingerboard, (2) an angle of the sensor bow relative to a first axis substantially parallel to a plane of the fingerboard and perpendicular to the longitudinal axis of the fingerboard, (3) a second position of the sensor bow along the longitudinal axis of the fingerboard, (4) a first rotational position of the sensor bow about a second axis normal to the fingerboard, or (5) a second rotational position of the sensor bow about a longitudinal axis of the bow stick.

14. The sensor bow system of claim 12 wherein the one or more electromagnetic radiation sources comprises an array of infrared light emitting diodes and the one or more orientation sensor systems comprises an infrared photodetector configured to detect infrared energy from the infrared light emitting diodes.

15. The sensor bow system of claim 14 wherein the array of infrared light emitting diodes comprises a first subset of diodes having a first orientation, and a second subset of diodes having a second orientation different from the first orientation, and wherein the first and second subsets of diodes are configured to transmit at different times.

16. The sensor bow system of claim 15 wherein the one or more electromagnetic radiation sources comprises a radio frequency source and the one or more orientation sensor systems comprises an antenna configured to detect radio frequency energy from the radio frequency source, the radio frequency source being configured to transmit the radio frequency energy with infrared synchronization information indicating which of the first and second subsets of diodes are active.

17. The sensor bow system of claim 12 wherein the one or more electromagnetic radiation sources comprises a radio frequency source and the one or more orientation sensor systems comprises the a pair of loop antennas configured to detect radio frequency energy from the radio frequency source, the loop antennas being integrated with the bow stick and oriented at 90 degrees to each other.

18. The sensor bow system of claim 12 wherein the sensor bow further includes a wireless transmitter configured to transmit the orientation data, the grip pressure data, and the bow hair tension data to a first wireless receiver associated with a computing device, and wherein the emitter assembly further includes a second wireless receiver configured to indicate presence of the sensor bow by receiving the transmissions from the wireless transmitter included in the sensor bow.

19. The sensor bow system of claim 12 further comprising a movement sensor system configured to generate movement data representing movement of the bow in one or more dimensions.

20. A computer-implemented method for controlling a control system in conjunction with a musical performance, comprising:

receiving sensor bow data generated by a sensor bow comprising a bow stick and bow hair, the sensor bow data including orientation data representing one or more orientations of the sensor bow relative to a stringed instrument, grip pressure data representing grip pressure exerted by a user of the sensor bow, and bow hair tension data representing tension of the bow hair;

mapping the orientation data, the grip pressure data, and the bow hair tension data to one or more control functions of the control system;

generating control information for controlling the control system from the orientation data, the grip pressure data, and the bow hair tension data with reference to the one or more control functions; and controlling operation of the control system using the control information.

* * * * *